US006733381B1

(12) United States Patent
Ploeger

(10) Patent No.: US 6,733,381 B1
(45) Date of Patent: May 11, 2004

(54) ROOF VENT AND METHOD OF INSTALLATION

(76) Inventor: Kurt Ploeger, 2650 Hazel, Beaumont, TX (US) 77702

( * ) Notice: Subject to any disclaimer, the term of this patent is extended or adjusted under 35 U.S.C. 154(b) by 0 days.

(21) Appl. No.: 10/604,412

(22) Filed: Jul. 18, 2003

(51) Int. Cl.[7] ..... F24F 7/02
(52) U.S. Cl. ..... 454/366; 454/367; 52/199
(58) Field of Search ..... 454/275, 358, 454/359, 367, 368, 366; 52/198, 199

(56) References Cited

U.S. PATENT DOCUMENTS 1,875,640 A * 9/1932 Moore ..... 285/44
2,251,965 A 5/1941 Peterson et al.
2,300,842 A 11/1942 Leslie
2,490,220 A 12/1949 Leslie
3,171,343 A * 3/1965 Wexler ..... 454/359
3,524,400 A * 8/1970 Magi ..... 454/78
4,537,119 A * 8/1985 Jarnot ..... 454/275
5,174,076 A 12/1992 Schiedegger et al.
5,394,663 A * 3/1995 Jackson ..... 52/199
5,591,080 A 1/1997 Ward
5,716,271 A * 2/1998 Paidosh ..... 454/359
5,797,222 A 8/1998 Martin
6,195,910 B1 * 3/2001 Robineau ..... 34/417
6,202,372 B1 3/2001 Powell
6,230,418 B1 * 5/2001 Gomulinski ..... 34/140
6,293,862 B1 9/2001 Jafine et al.
6,458,029 B2 10/2002 Morris

* cited by examiner

*Primary Examiner*—Derek S. Boles
(74) *Attorney, Agent, or Firm*—Gary L. Bush; Andrews Kurth LLP

(57) ABSTRACT

A two-piece apparatus available in varying widths for ventilating the attic space of a building with a pitched roof, comprising a base formed by a plate with angled tracks surrounding a opening therein to be first mounted over an opening in the roof, and a hood which covers the openings from water ingress and which is designed and arranged to slide into and be captured by said angled tracks without the use of additional fasteners. The hood contains a screened opening which faces the leeward side. Two-step installation allows the base to be fastened from the rooftop in locations internal to the vent.

4 Claims, 5 Drawing Sheets

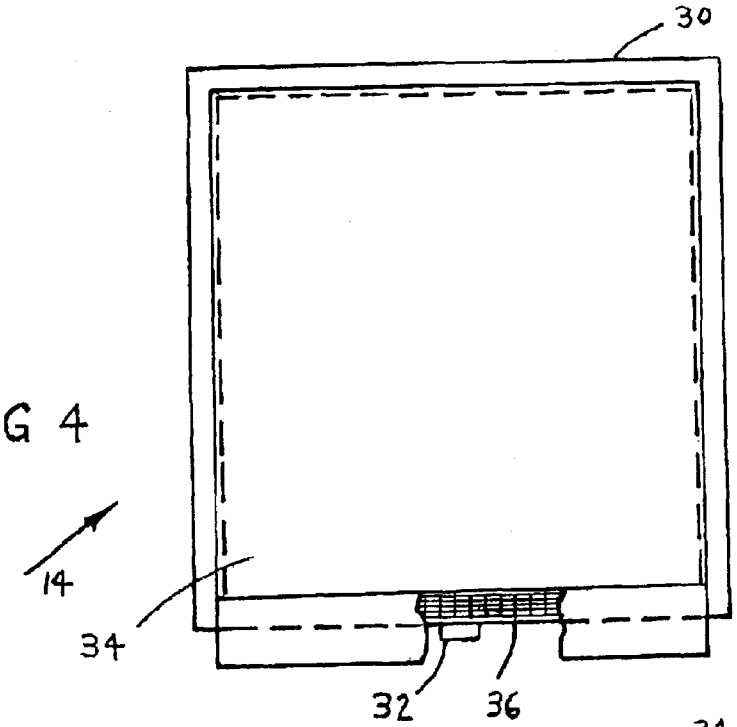
FIG 4
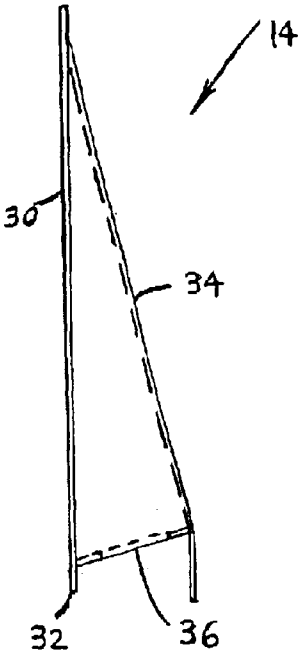
FIG 5
FIG 6

ROOF VENT AND METHOD OF INSTALLATION

BACKGROUND OF INVENTION

1. Field of the Invention

This invention relates generally to roof ventilating devices and specifically to a roof vent for ventilating the attic space of a building with a pitched roof.

2. Description of the Prior Art

The need to ventilate air within an attic is well recognized. Without ventilation, condensation may occur which can spot and damage ceilings, and it is more costly to air condition the building during the warmer months.

Although forced-convection ventilators are available, it is often preferable to allow natural circulation of air within the attic by vents located both near the peak of the roof and in the underside of the eaves. Such vents can be simple, be energy efficient and provide minimal aesthetic degradation to the roofline.

Vents on a pitched roof must prevent water running down a roof or wind-driven rain from entering the attic. One such vent of prior art for use on pitched roofs is disclosed in U.S. Pat No. 2,300,842 (Leslie). A difficulty with prior art vents of this type exists when installing the vent on an existing roof. Because the vent is a one-piece unit, it must be installed from underneath the roof or fastened through the shingles and caulked with sealant at its flashing. A vent which can be readily fastened from the rooftop but within the vent enclosure itself may allow easier retrofitting of existing roofs.

U.S. Pat. No. 5,394,663 and U.S. Pat. No. 6,293,862 disclose vents of two-piece construction. While these designs allow simplified installation, they are designed and arranged to receive a plumbing vent pipe or exhaust fan duct and not to maximize ventilation of an attic space.

To promote natural circulation, resistance to air flow should be minimized. The larger the area of a vent's opening (s), the less resistance there is to air flow. For aesthetic reasons and to minimize potential wind damage, vents are preferably widened rather than made taller in order to increase air flow.

A fairly recent development in roof vents is that of the ridge vent, as typified by U.S. Pat. No. 5,174,076 or U.S. Pat. No. 5,797,222. The ridge vent boasts the advantage of being disposed at the highest locations in a roof top and have maximum width to promote ventilating and prevent stagnant pockets of air within an attic. Unfortunately, because of the difficulty inherent in installing a ridge vent in an existing roof, their use is essentially limited to new construction.

A vent which can be installed on the pitched portion of a roof, yet which is available in greater widths, is desirable. U.S. Pat. No. 6,202,372 shows just such a vent. However, as with the early prior art vents such as described by Leslie, this vent is of one-piece construction. For installation on an existing roof, it poses the difficulties mentioned above.

Identification of Objects of the Invention

A primary object of the invention is to provide a roof vent for ventilating attic space of a building with a pitched roof which is easily installed on a new roof.

Another object of the invention is to provide a roof vent for ventilating attic space which is easily and quickly installed on an existing pitched roof from the rooftop.

Another object of the invention is to provide a roof vent for ventilating attic space which is installed on an existing pitched roof which does not require fastening at external flashing or the use of sealing compound.

Another object of the invention is to provide a roof vent for ventilating attic space which is available in varying widths to meet the unique demands of each installation and to promote ventilation.

Another object of the invention to provide a roof vent for ventilating attic space which is aesthetically pleasing.

SUMMARY OF INVENTION

The objects identified above, as well as other features and advantages of the invention are incorporated in an apparatus of two piece construction for ventilating the attic space of a pitched-roof building, comprising a base formed by a plate with angled tracks surrounding a opening therein to be first mounted over an opening in the roof, and a hood which covers the openings from water ingress and which is designed and arranged to slide into and be captured by said angled tracks without the use of additional fasteners. The hood includes a screened opening which faces the leeward side (i.e. facing the downward slope of the roof) to allow weathertight ventilation and to exclude small animals. Because the vent is installed in a two step process, the base is designed to be fastened from the rooftop in locations internal to the vent. The vent is designed for manufacture in varying widths to accommodate varying air flow and roofing requirements.

BRIEF DESCRIPTION OF DRAWINGS

The invention is described in detail hereinafter on the basis of the embodiments represented schematically in the accompanying figures, in which:

FIG. 4 is a top view of the hood;

FIG. 5 is a front view of the hood;

FIG. 6 is a side view of the hood;

DETAILED DESCRIPTION

Figure 1:
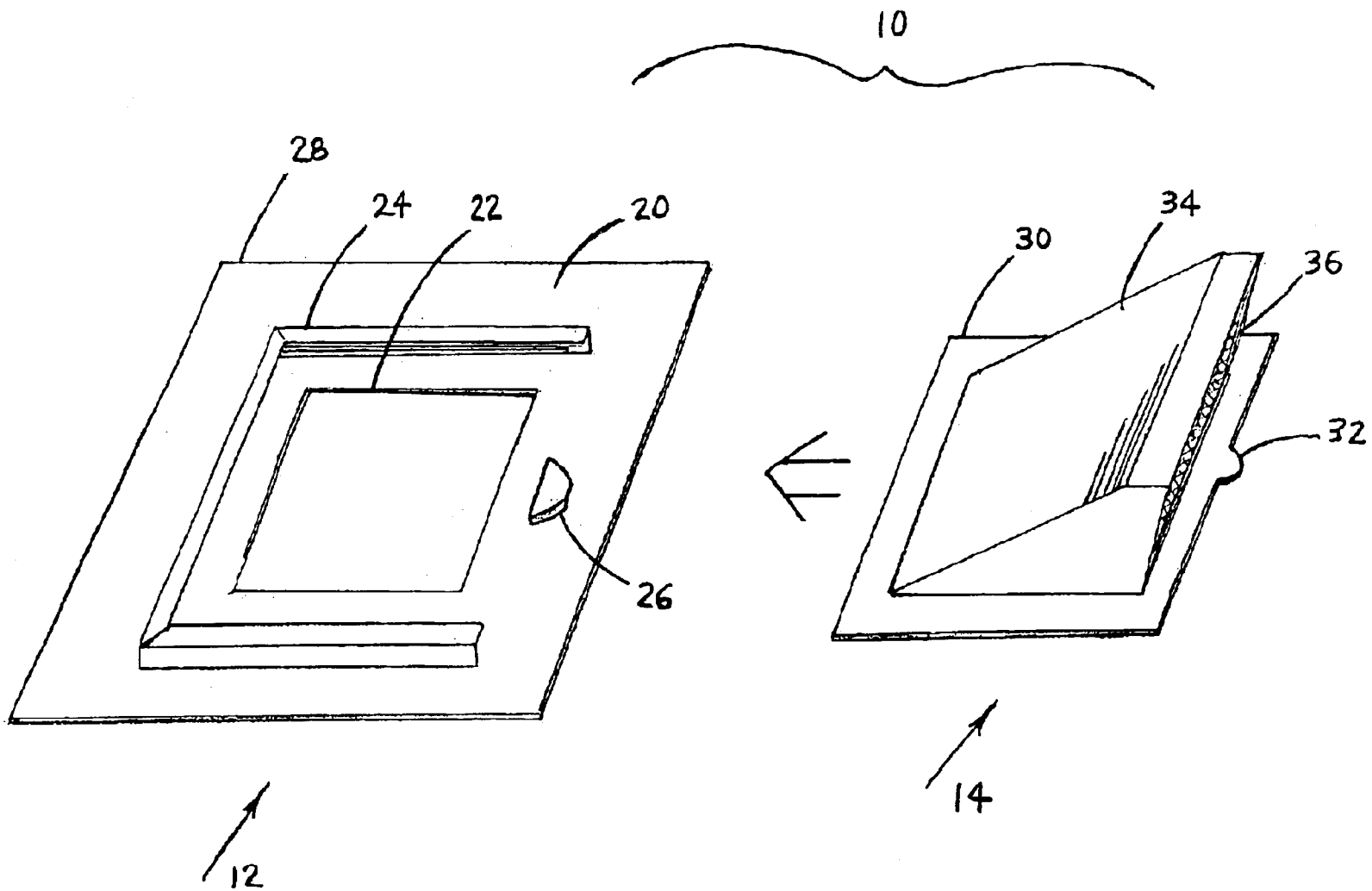
FIG. 1 depicts the roof vent of the present invention comprising an interlocking base and hood.

FIG. 1 illustrates the roof vent 10 of this invention. The vent 10 includes a base 12 and a hood 14, which "snap" together to form a single unit when installed. Vent 10 is preferably manufactured from ozone-resistant rigid plastic material, but is not limited to such.

The base 12 consists of a plate 20 with an opening 22 passing through it. Surrounding 270 degrees of the opening are angled tracks 24. Base 12 also includes one or more raised recesses 26. The periphery of plate 20, because of its water-shedding interaction with the surrounding shingles, is referred to as flashing 28. In order to simplify installation of base 12, its bottom surface 29 (see FIG. 3) is flat.

The hood 14 is designed and arranged with flanges 30 sized to slide into and be captured by the angled tracks 24.

Hood 14 includes a number of locking tabs 32 equal to the number of raised recesses 26 contained in the base. The locking tabs 32 are positioned to correspond to the raised recesses 26 and are locked therein during installation. In order for a locking tab 32 to clear the top edge of corresponding raised recess 26, it is necessary for the user to elastically compress hood 14. When the exerted force is removed, locking tab 32 slides into raised recess 26 and is captured therein. The number of tab/recess pairs required is a function of the width of vent 10 and design windstorm requirements. Hood 14 also contains a cover 34 and a screened opening 36 which allows air to pass into or out of the base opening 22 when the base 12 and hood 14 are interlocked. The angle of cover 34 is designed to shed rain even when vent 10 is installed on gently sloped roofs.

Figure 3:
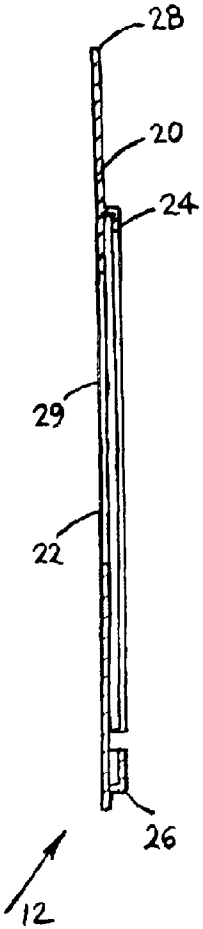
FIG. 3 is a section view of the base taken along lines 3—3 of FIG. 2.
Figure 2:
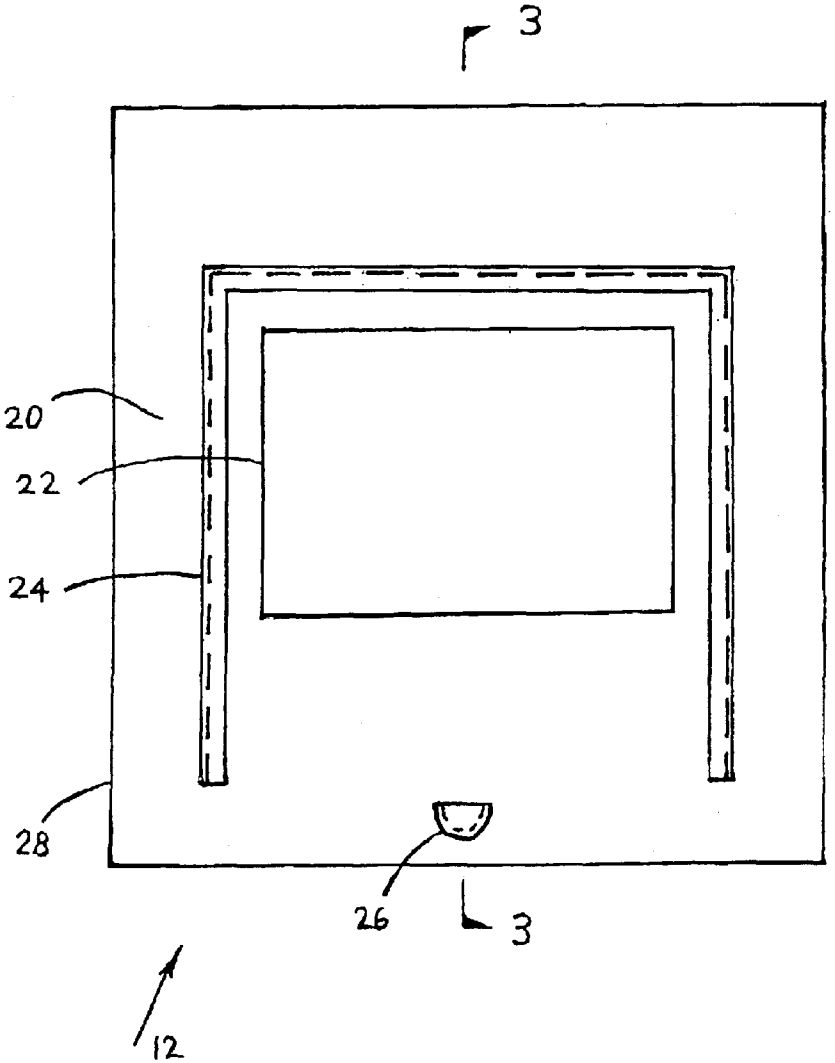
FIG. 2 is a top view of the base.
Figure 8:
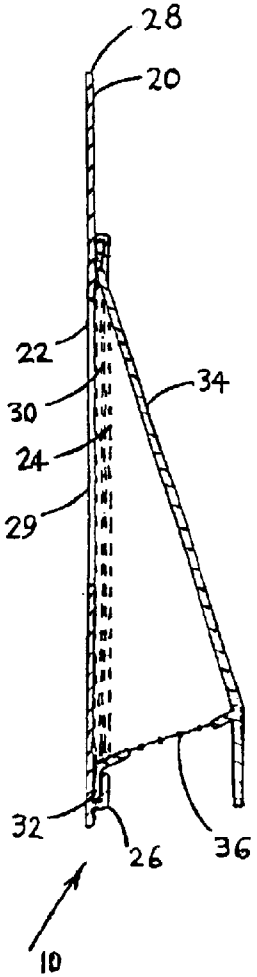
FIG. 8 is a section view of base and hood in the interlocked position taken along lines 8—8 of FIG. 7.
Figure 7:
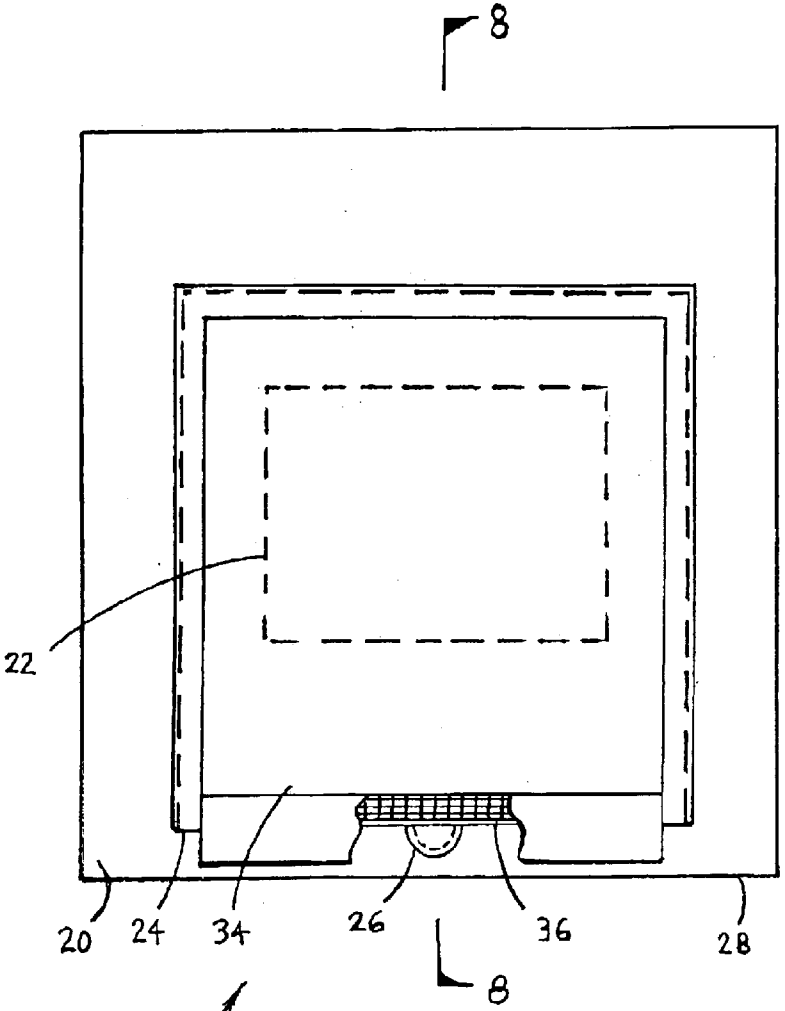
FIG. 7 is a top view of the base and hood in the interlocked position.

FIGS. 2 and 3 provide greater detail of base 12 through orthographic views. Likewise, FIGS. 4 though 6 illustrate the construction of hood 14. Finally, FIGS. 7 and 8 detail roof vent 10 wherein base 12 and hood 14 are interlocked.

Figure 9:
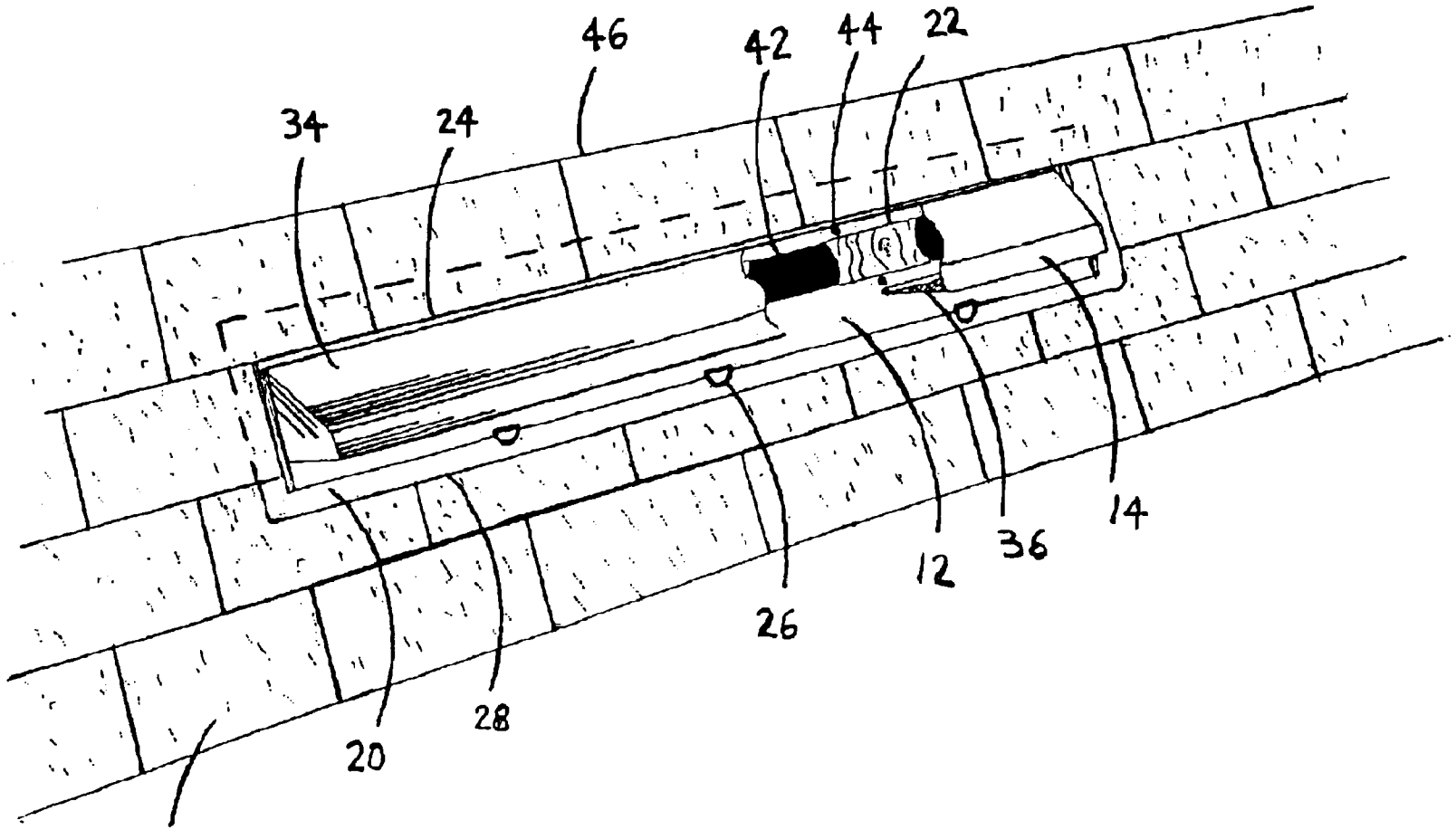
FIG. 9 illustrates a widened roof vent of this invention installed in a shingled pitched roof, with a section of the hood cut away to reveal an internal portion of the hood.

FIG. 9 depicts roof vent 10 installed on a composite shingle pitched-roof 40. However, the invention is not limited to composite shingled roofs and may be used with a roof constructed of virtually any material. In this illustration, the vent 10 is four shingles wide, where width is defined as the dimension perpendicular to the roof rafters above which the vent is designed to be installed. Compared with the one shingle wide vent 10 as illustrated in FIGS. 1 through 8, this wider vent 10 allows greater air flow through the attic. Within the scope of this invention, vent 10 may be manufactured in a variety of widths to accommodate the needs of the user, but will preferably exist in integral shingle widths.

Vent 10 is installed on roof 40 over one or more holes 42 formed in the roof. Unlike some vents of prior art, vent 10 has a flat bottom surface 29. Since no projections from the vent enter into the roof, hole 42 size and shape is only limited to that which can be covered by base 12 and which provides ample room for fasteners. Base 12 is positioned to generally align hole(s) 42 and opening 22 so that air may then vent from the attic through hole(s) 42, through base opening 22 and to the atmosphere through screened opening 36. Cover 34 prevents rain and snow from entering into the attic via hole(s) 42, and screened opening 36 excludes birds and other small animals from the vent or attic.

Vent 10 is sealed to roof 40 by means of base 20 which acts as flashing 28. As detailed in FIG. 9, the superior (weatherward) portion of flashing 28 is weatherboarded under the shingles 46 while the inferior (leeward) portion of flashing 28 laps over the shingles 46 to exclude and shed rain. Side portions of flashing 28 may either be disposed above or below the shingles 46. Screened opening 36 faces away from weather side to keep the vent weathertight.

To install roof vent 10, appropriately-sized holes are formed through the roof where vent 10 is to be located. During a new roof installation or a re-shingling, shingles 46 are laid up to cut-out(s) 42. Base 12 is installed using roofing nails, screws or lag bolts (and possibly adhesive/sealant). Shingles 46 are weatherboarded over the top and side flashing 28 of base 12 to tracks 24. Any nails in the superior and side portions of flashing 28 are thus covered by shingles 46 to prevent water ingress through the nail holes. Hood 14 is slid and snapped in place, and installation is complete.

Although vent 10 is most easily installed during roof construction, because of its two-piece design, it is particularly suited for installation in existing roofs. When one-piece roof vents of prior art are installed on an existing roof, they can only be fastened along their flashing or possibly, from within the attic. When shingles 46 are folded back to allow nailing, they are often damaged. If nails are driven through both the shingles 46 and the flashing, water may readily ingress through the nail holes along the shafts of the nails unless care is taken to apply sealant around the nail heads. However, because vent 10 of this invention uses a two piece design where the base 12 is secured to the roof 40 without the hood 14, nails can easily be driven anywhere in plate 20 inside tracks 24 as shown by nail 44 in FIG. 9. Because the nails will subsequently be covered by hood 14, water ingress is avoided without the need to apply sealant to the nail heads. Thus, flashing 28 is easily slid under the superior shingles without damaging the shingles 46. Base 12 is secured to the roof with fasteners 44 located within tracks 24, and hood 14 is snapped in place. On an existing roof, typical installation time is about five minutes.

While preferred embodiments of the invention have been illustrated in detail, it is apparent that modifications and adaptations of the preferred embodiments will occur to those skilled in the art. It is to be expressly understood that such modifications and adaptations are in the spirit and scope of the invention as set forth in the following claims:

What is claimed is:

1. A roof vent (10) comprising, a generally planar base (12) having an opening (22) formed therein and a flat bottom surface (29), and a hood (14) designed and arranged to be removably attached to said base, wherein said hood provides a weathertight cover (34) over said opening while allowing generally unencumbered communication of air between said opening and the atmosphere.

2. The roof vent (10) of claim 1 further comprising, tracks (24) attached to an upper surface said base(12), said tracks extending along sides adjacent said opening (22), and flanges (30) disposed on said hood (14) and attached thereto, said flanges arranged and designed to be slideably received in said tracks.

3. The roof vent (10) of claim 1 wherein, the width of said roof vent is greater than the length of said roof vent.

4. The roof vent (10) of claim 1 wherein, said hood (14) is designed and arranged to be removably attached to said base (12) by application of a compressive force on said hood.

* * * * *

UNITED STATES PATENT AND TRADEMARK OFFICE

CERTIFICATE OF CORRECTION

PATENT NO. : 6,733,381 B1
DATED : May 11, 2004
INVENTOR(S) : Kurt Ploeger

It is certified that error appears in the above-identified patent and that said Letters Patent is hereby corrected as shown below:

Column 4,
Line 43, after the word "atmosphere", insert

-- and one or more raised recesses (26) disposed on said upper surface of said base (12) and attached thereto, said base positioned on a roof, and one or more locking tabs (32) disposed on said hood (14) and attached thereto, said one or more locking tabs arranged and designed to be disposed in said one or raised recesses, wherein said one or more locking tabs disposed in said one or more raised recesses prevents said hood for slideably uncoupling from said base --

Signed and Sealed this

Twenty-second Day of March, 2005

JON W. DUDAS
*Director of the United States Patent and Trademark Office*